US005095823A

United States Patent [19]

McKeown, Jr.

[11] Patent Number: 5,095,823

[45] Date of Patent: Mar. 17, 1992

[54] FRICTION SHOE FOR RAILCAR TRUCK

[75] Inventor: Franklin S. McKeown, Jr., St. Louis, Mo.

[73] Assignee: Amsted Industries Incorporated, Chicago, Ill.

[21] Appl. No.: 628,380

[22] Filed: Dec. 17, 1990

[51] Int. Cl.[5] ..... B61F 5/06

[52] U.S. Cl. ..... 105/198.2; 105/198.5

[58] Field of Search ..... 105/198.5, 207, 198.2, 105/193

[56] References Cited

U.S. PATENT DOCUMENTS

| | | | |
|---|---|---|---|
| 2,159,138 | 5/1939 | Duryea | 105/207 X |
| 2,257,109 | 9/1941 | Davidson | 105/198.5 |
| 2,378,414 | 6/1945 | Light . | |
| 2,378,415 | 6/1945 | Light . | |
| 2,437,359 | 3/1948 | Pierce | 105/198.5 |
| 2,485,104 | 10/1949 | Maatman | 105/198.5 |
| 2,485,973 | 10/1949 | Lehrman | 105/198.5 |
| 2,660,129 | 11/1953 | Wulff | 105/198.5 |
| 2,682,232 | 6/1954 | Wulff | 105/198.5 |
| 2,727,472 | 12/1955 | Forssell | 105/198.5 |
| 3,517,620 | 6/1970 | Weber . | |
| 3,716,903 | 2/1973 | Tack | 105/198.5 X |
| 3,805,707 | 4/1974 | Neumann et al. . | |
| 4,103,623 | 8/1978 | Radwill . | |
| 4,109,585 | 8/1978 | Brose . | |
| 4,256,041 | 3/1981 | Kemper et al. . | |
| 4,274,340 | 6/1981 | Neumann et al. . | |
| 4,825,776 | 5/1989 | Spencer | 105/198.5 |
| 4,953,471 | 9/1990 | Wronkiewicz et al. . | |

FOREIGN PATENT DOCUMENTS

| | | | |
|---|---|---|---|
| 2488847 | 2/1982 | France | 105/198.2 |

*Primary Examiner*—Margaret A. Focarino
*Assistant Examiner*—Joseph D. Pape
*Attorney, Agent, or Firm*—Edward J. Brosius; F. S. Gregorczyk

[57] ABSTRACT

The present invention provides a friction shoe for use in a railway freight car truck. The friction shoe is disposed to dampen movements between the truck bolster and the side frames, and consists of a unitarily cast metal body having a generally planar vertical wear plate adapted to frictionally engage a column on the truck side frame. The back surface of the vertical wear plate is augmented to create a thicker cross sectional area at either the upper or lower ends of the plate, depending on the type of shoe being used. The augmented shoe provides a longer wearing friction surface which requires less frequent replacement and lower costs.

4 Claims, 2 Drawing Sheets

FRICTION SHOE FOR RAILCAR TRUCK

BACKGROUND OF THE INVENTION

This invention relates to railcar trucks and more particularly to friction shoes having a tapered vertical wall.

A typical freight railcar truck comprises wheelsets mounted on two axles which support side frames at each side of the railcar and a transverse bolster extending between the side frames with the ends thereof supported between two vertical columns on load springs carried by each side frame. Usually a truck is located under each end of a railcar and the car itself is pivotally supported upon a centerplate centrally positioned on each bolster. Thus the weight of the railcar will cause the ends of the bolsters to move vertically on the load springs while confined between the vertical columns.

To provide proper damping for the suspension system, friction shoes are spring biased in pockets to frictionally retard vertical movement between the bolster and the side frame columns. Although it is possible to locate such pockets in the side frame columns, it is more common to locate the pockets in the bolster, usually two opposed pockets at each bolster end. The friction shoes have vertically disposed walls with substantially flat, outward friction faces which contact friction plates secured to the opposite truck component. In certain types of such friction shoes there is a shoe slope surface, generally opposite the friction face, which declines from a top portion of the friction shoe to a bottom portion thereof and away from the friction face and which slope surface engages a sloped surface on the inside of the pocket. The latter type shoe also has a bottom opening or hole through which a control spring extends to the top portion of the shoe. Some friction shoes include elastomer pads or coatings on the sloped surfaces to reduce wear on those surfaces and thereby extend service life. The control spring urges the friction shoe against the pocket sloped surface and upwardly through the pocket, while the slope also guides the shoe outwardly of the pocket against the opposite truck member such as the friction plate on the frame vertical column.

The frictional forces of the friction shoe surfaces against both the sloped surfaces of the bolster end and particularly against the side frame column friction plates tend to damp the oscillations of the bolster relative to the side frame and thereby lessen the dynamic motions of the freight car.

THE PRIOR ART

A large variety of friction shoe designs and arrangements are described in prior United States Patents. Examples may be found in U.S. Pat. Nos. 2,378,414; 2,378,415; 3,805,707; 4,103,623; 4,109,585; 4,256,041; 4,274,340; 4,825,776 and 4,953,471.

A problem in such arrangements is that the major vertical friction surfaces on both the wear plates and the friction shoes tend to wear away. When the friction surface of a friction shoe becomes excessively worn the shoe must be removed and discarded, in some cases prematurely, as a result of uneven wear on the vertical wall. Such uneven wear occurs due to a rotational movement imparted to the shoe by downward bolster forces against the shoe slope surface. Usually this results in greater wear at the lower portion of the shoe vertical friction face and the structural integrity of the shoe becomes questionable as the vertical wall thickness is reduced by wear. In some designs the shoe may be subjected to greater wear at the upper portion of the vertical friction face.

SUMMARY OF THE INVENTION

Accordingly, an object of the present invention is to provide a rail truck friction shoe that can accept wear and abrasion yet have a relatively longer service life with minimal addition of weight.

Another object of the present invention is to provide a rail truck friction shoe having a vertical wall of increased thickness localized at the area of greatest potential wear.

By the present invention, it is proposed to overcome the difficulties outlined heretofore by constructing the friction shoe vertical wall with an inwardly directed triangular or tapered cross section to provide a greater wall thickness at the portion of the friction face that is subjected to the greater frictional forces and wear due to the aforementioned rotational movement. Thus as the vertical friction face is abraded during service there will remain adequate wall thickness to assure structural integrity. Although the vertical friction face will become slightly curved (convex), due to such wear, it will continue to provide sufficient damping without premature shoe replacement.

BRIEF DESCRIPTION OF THE DRAWINGS

Further objects and advantages will become apparent upon reading the following detailed description in conjunction with the drawings wherein.

DETAILED DESCRIPTION OF THE INVENTION

Figure 1:
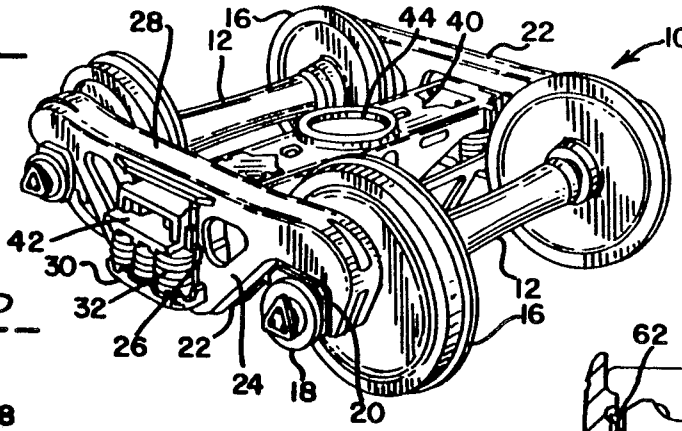
FIG. 1 is a perspective view of a railcar truck.

Referring now to FIG. 1 of the drawings, a typical railway truck is shown generally at 10. The truck comprises a pair of axles 12, each of which supports two railway wheels 16. The ends of each of axles 12 include roller bearing assemblies 18 which are mounted under pedestal jaws 20 in each of a pair of side frames generally 22. Each side frame 22 is comprised of a tension member 24 extending downwardly from pedestal jaws 20 and two vertical side frame columns 26 extending upwardly from the lower portion of tension members 24 to a horizontal compression member 28 which is the uppermost portion of side frame 22 connecting jaws 20. Side frame columns 26 are spaced to form a bolster opening therebetween. A bottom spring support shelf 30 extends outwardly from a lower section of side frame 22 to receive the bottom end of spring group load coils 32. A bolster generally 40 extends parallel to axles 12 and has ends 42 each extending through one of the side frame bolster openings. Each bolster 40 includes a center bowl 44 into which the freight car body bolster center plate (not shown) is received.

Figure 2:
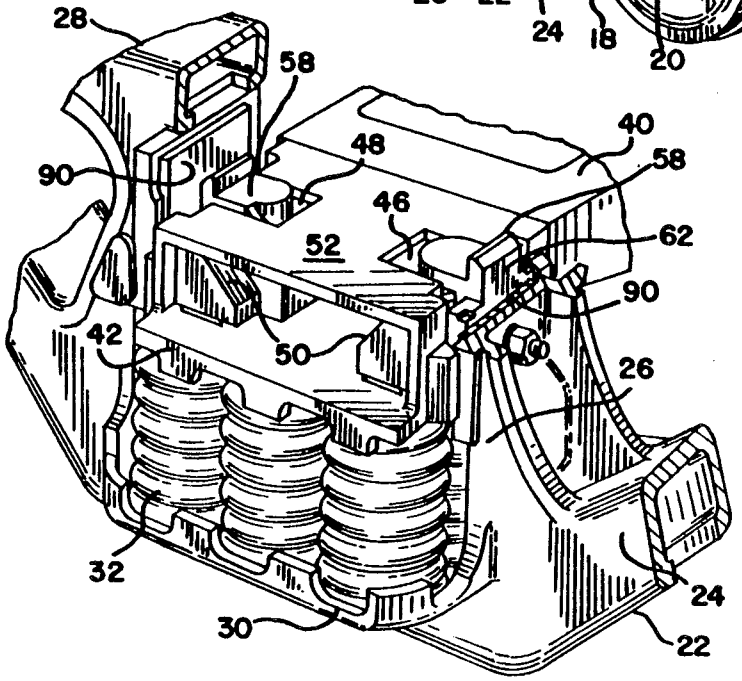
FIG. 2 is an enlarged perspective view of a portion of the truck shown in FIG. 1, with portions broken away for clarity, showing the interface between truck bolster, friction shoes and vertical columns of one side frame.
Figure 3:
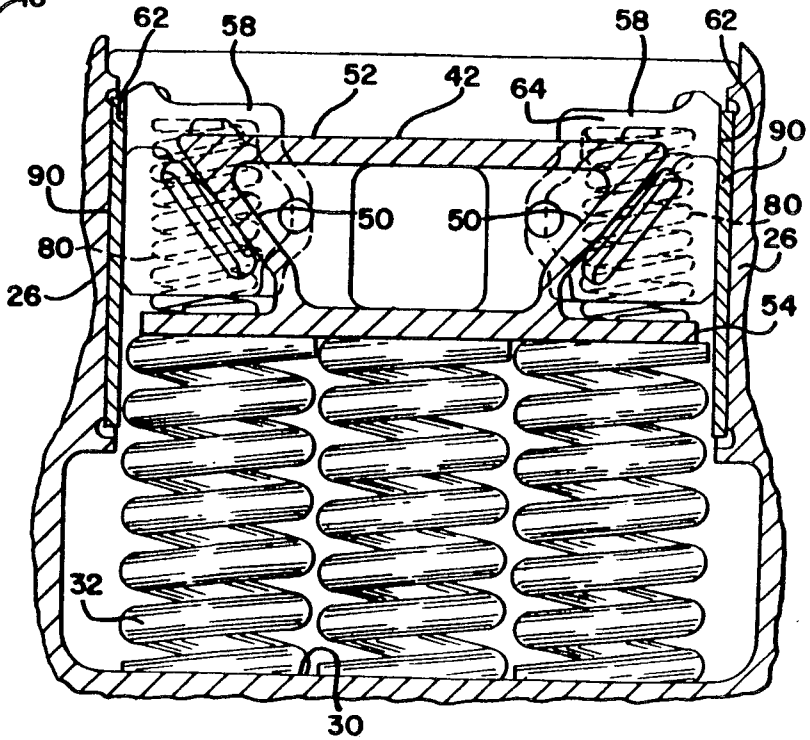
FIG. 3 is an enlarged end view, partially in section, of a portion of the bolster and side frame of FIG. 2.
Figure 4:
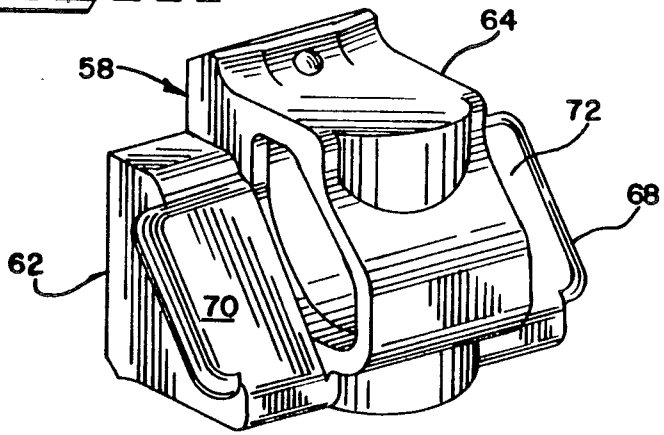
FIG. 4 is a perspective of one type of friction shoe apart from the truck of FIGS. 1-3.

Referring now to FIGS. 2 and 3, detailed views of a typical bolster end 42 extending between side frame columns 26 are shown. Bolster end 42 is seen to include two oppositely facing friction shoe pockets 46, 48 which are mirror images of each other. Each friction shoe pocket 46, 48 extends inwardly into a side of bolster end 42 and includes sloped walls 50 extending downwardly at an acute angle from an opening in a top wall 52 to a bottom wall 54 of bolster 40. Identical friction shoes generally 58 are received within each friction shoe pocket 46, 48. In the construction illustrated in FIGS. 4 and 5, friction shoe 58 comprises a cast metal body including a generally vertical wall 60 with a planar, and vertical outer friction face 62, a central barrel section 64 behind the vertical wall 60 and two outward wings 66, 68 extending downwardly at an acute angle to an upper portion of friction face 62. A control spring 80 is received within an opening in the bottom of each friction shoe 58 and extends upwardly into the barrel section 64 thereof to urge the shoe sloped surfaces 70, 72 against the sloped pocket walls 50 and thereby urges the shoe to move outwardly of the pocket toward side frame column 26. Control spring 80 has a bottom edge resting on the bolster bottom wall 54 in the friction shoe pocket in bolster 40. In some bolster designs (not shown) the control spring extends downward to spring support shelf 30.

It will also be seen in FIGS. 2 and 3 that a wear plate 90 is bolted or welded to each vertical column 26 of a side frame 22. Such wear plates 90 are flat and provide a replaceable friction surface to receive the friction faces 62 of shoes 58.

As railway truck 10 travels on a railway track with the freight car supported thereon, bolster 40 will oscillate vertically between the side frame columns 26. Such oscillation is accommodated by coil spring group 32, with friction shoes 58 acting to damp oscillating movement of bolster 40 in side frame 22. Such damping is provided by the vertical friction face 62 of a friction shoe 58 rubbing against a side frame column friction plate 90. Further, inner surfaces of sloped walls 50 of bolster pockets 46, 48 contact corresponding sloped surfaces 70, 72 of friction shoes 58. Sloped surfaces 70, 72 of each friction shoe 58 typically extend at angles between 30° and 45° outwardly from vertical friction faces 62 and correspond to the sloped surfaces of bolster pocket walls 50 which are cast to extend at similar angles from the vertical. Downward forces of the bolster 40 will be exerted against the shoe sloped surfaces 70, 72 and impart a rotational movement (usually clockwise as viewed in FIG. 5) causing the bottom portion of friction face 62 to exert a relatively greater pressure against the wear plate 90 and consequently abrade more rapidly than the upper portion thereof.

Figure 5:
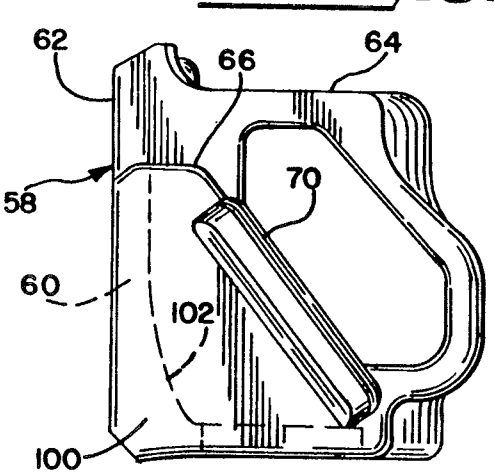
FIG. 5 is a side elevation view of the type friction shoe of FIG. 4 modified to include the present invention.

To compensate the resultant uneven wear on the shoe friction face 62 and avoid premature failure or rejection, the present invention provides, as shown in FIG. 5, for augmenting a lower portion 100 of the vertical wall 60 where it joins the shoe bottom by casting an enlarged or triangular cross section 102 that tapers away from the friction face 62 and inwardly of the shoe barrel section 64.

Figure 7:
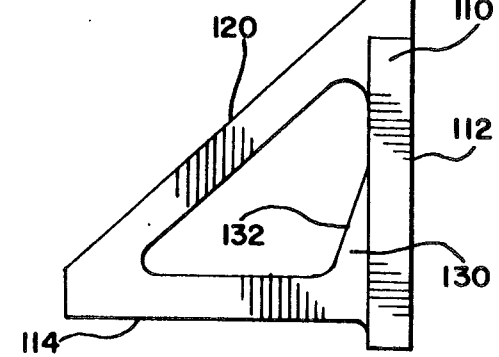
FIG. 7 is a side elevation view of the friction shoe of FIG. 6.
Figure 6:
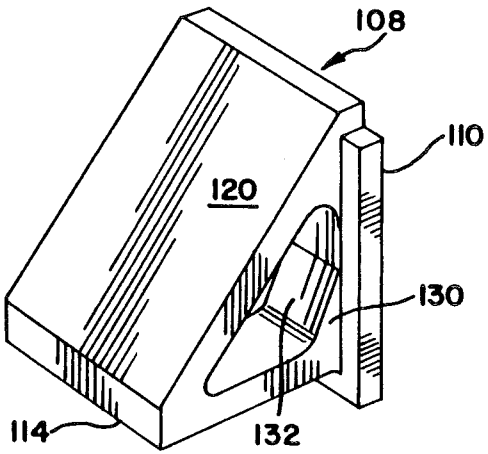
FIG. 6 is a perspective view of another type of friction shoe embodying the present invention.

Another design of a basic friction shoe 108, shown in FIGS. 6 and 7, comprises a vertical wall 110, with outward friction face 112, and a horizontal base 114 extending at a right angle thereto. Shoe 108 has a single broad sloped surface 120 extending from the top of the vertical wall 110 to the end of the horizontal base 114. To augment the vertical wall 110 the lower portion 130 thereof is provided with flared or tapered section 132 inwardly onto the base 114.

Should a particular shoe and bolster pocket design result in a reverse rotational movement causing the upper portion of a vertical friction face to exert greater pressure and abrade more rapidly, the enlarged cross section may be cast in the upper portion of the shoe vertical wall so as to taper or flare toward the barrel top or sloped surface of the shoe.

The foregoing detailed description has been given for clearness of understanding and to provide a complete description of a preferred embodiment of the invention. Various modifications may be made without departing from the spirit and scope of the invention which is defined in the following claims.

What is claimed is:

1. An improved unitarily cast rail car truck friction shoe, said shoe comprising a central barrel portion having a bottom configured to receive an upper end of a compression spring, a generally vertical wear plate cast as part of said central barrel portion, and a pair of spaced triangular wings projecting laterally outward from said central barrel portion, each of said wings cast as part of said vertical wear plate to form a single homogenous vertical planar friction face across the entire casting, said homogenous vertical planar friction face having a front and back surface and a top and bottom end, each of said wings also having a sloped surface such that said homogenous vertical planar friction face and each of said sloped surfaces define an intersection, said sloped surfaces being angled downwardly and outwardly away from said intersection to said barrel portion of said friction shoe, the improvement comprising:

augmenting means to structurally strengthen said vertical planar friction face back surface wherein said augmenting means is proximate to said bottom end of said vertical planar friction face, said augmenting means being a tapered cross section of said vertical planar friction face which flares downwardly and outwardly in a direction away from said back surface.

2. The friction shoe of claim 1 wherein said augmenting means is cast as part of said bottom of said friction shoe.

3. An improved railcar truck friction shoe comprising a generally vertical wear plate having a front surface and a back surface and a top end and a bottom end, a base connected to said bottom end of said vertical wear plate, and a sloped surface connected to said top end of said vertical wear plate extending downwardly and outwardly away from said top of said vertical wear plate to said base, the improvement comprising: augmenting means to structurally strengthen said vertical planar wear plate wherein said augmenting means is located at said bottom end of said vertical wear place back surface, said augmenting means comprising a tapered cross section of said vertical wear plate back surface which flares downwardly and outwardly in a direction away from said back surface of said vertical friction face.

4. The friction shoe of claim 3 wherein said augmenting means is also cast as part of the bottom of said friction shoe.

* * * * *